US010577901B2

(12) United States Patent
Mineo et al.

(10) Patent No.: US 10,577,901 B2
(45) Date of Patent: Mar. 3, 2020

(54) WELLBORE PLUG WITH A ROTARY ACTUATED VARIABLE CHOKE

(71) Applicant: Halliburton Energy Services, Inc., Houston, TX (US)

(72) Inventors: Richard Mineo, Richardson, TX (US); Dominick J. Bellotte, Flower Mound, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 239 days.

(21) Appl. No.: 15/538,130

(22) PCT Filed: Jan. 16, 2015

(86) PCT No.: PCT/US2015/011871
§ 371 (c)(1),
(2) Date: Jun. 20, 2017

(87) PCT Pub. No.: WO2016/114800
PCT Pub. Date: Jul. 21, 2016

(65) Prior Publication Data

US 2017/0350220 A1 Dec. 7, 2017

(51) Int. Cl.

| | |
|---|---|
| ***E21B 43/12*** | (2006.01) |
| ***E21B 33/12*** | (2006.01) |
| *E21B 7/00* | (2006.01) |
| *E21B 34/00* | (2006.01) |

(52) U.S. Cl.
CPC ..... *E21B 43/12* (2013.01); *E21B 33/12* (2013.01); *E21B 7/00* (2013.01); *E21B 34/00* (2013.01)

(58) Field of Classification Search
CPC ..... E21B 43/12; E21B 33/12; E21B 21/08
See application file for complete search history.

(56) References Cited

U.S. PATENT DOCUMENTS 5,273,112 A 12/1993 Schultz
6,276,458 B1 * 8/2001 Malone ..... E21B 21/10 166/240
6,338,385 B1 1/2002 Muchow
(Continued)

FOREIGN PATENT DOCUMENTS

WO 2008009955 A1 1/2008

OTHER PUBLICATIONS

International Search Report and Written Opinion dated Oct. 7, 2015; International PCT Application No. PCT/US2015/011871.

*Primary Examiner* — Catherine Loikith
(74) *Attorney, Agent, or Firm* — McGuireWoods LLP

(57) ABSTRACT

A method for controlling fluid flow through a wellbore by introducing a plug with a variable choke into the wellbore, setting the plug in the wellbore, and mechanically adjusting the variable choke in the wellbore, thereby controlling a flow rate of a fluid through the plug. A plug that can control fluid flow through a flow passage in a wellbore, where the plug can include a body, an annular seal element that prevents fluid flow through an annulus between the plug and the wellbore, and a variable choke, where a closure member of the choke is mechanically rotated downhole to adjust a fluid flow rate through the choke. A method that can include producing fluids from two zones and using a plug to control a ratio of the fluids in a produced mixture.

20 Claims, 4 Drawing Sheets

(56) References Cited

U.S. PATENT DOCUMENTS

| | | | | |
|---|---|---|---|---|
| 7,258,323 | B2 * | 8/2007 | Dwivedi | F16K 5/0428 166/332.2 |
| 7,429,030 | B2 * | 9/2008 | Dwivedi | F16K 5/0428 166/332.2 |
| 7,594,542 | B2 * | 9/2009 | Loretz | E21B 23/004 166/320 |
| 10,145,206 | B2 * | 12/2018 | Williamson | E21B 34/14 |
| 2006/0284134 | A1 | 12/2006 | Dwivedi | |
| 2009/0032244 | A1 | 2/2009 | Zupanick | |
| 2009/0065199 | A1 | 3/2009 | Patel et al. | |

* cited by examiner

WELLBORE PLUG WITH A ROTARY ACTUATED VARIABLE CHOKE

TECHNICAL FIELD

A wellbore plug with a rotary actuated variable choke and methods of controlling fluid flow through a flow passage in a wellbore. The plug can include profiles that engage mating profiles of a rotary actuator, thereby allowing mechanical actuation of the plug downhole to adjust a flow rate through the plug. According to certain embodiments, the plug is used in an oil or gas well operation.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
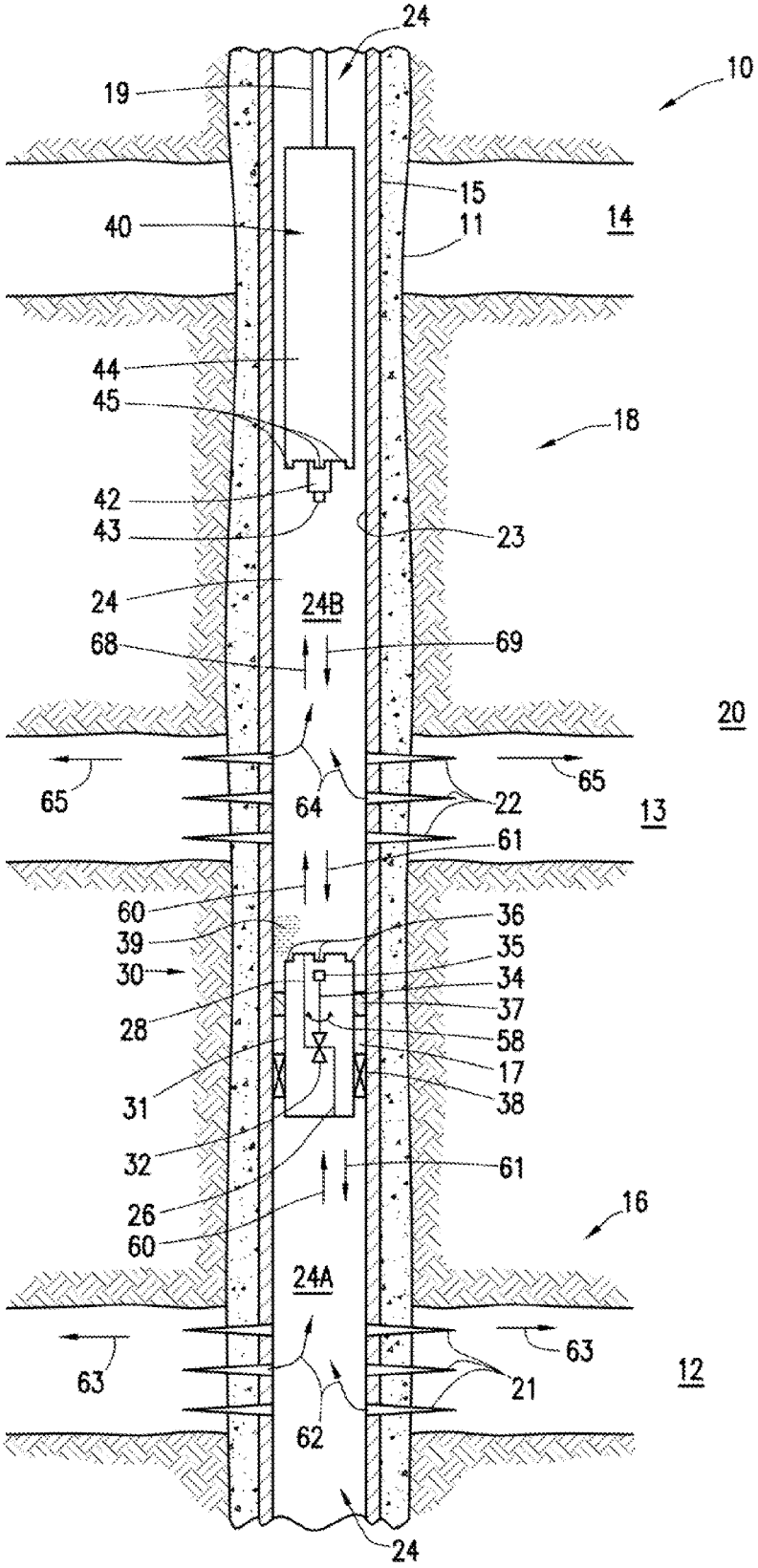
FIG. 1 depicts a schematic diagram of a well system containing a plug with a rotary actuated variable choke that can be adjusted downhole by a rotary actuator to control fluid flow through a flow passage in a wellbore.

Oil and gas hydrocarbons are naturally occurring in some subterranean formations. In the oil and gas industry, a subterranean formation containing oil or gas is referred to as a reservoir. A reservoir may be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from a reservoir is called a reservoir fluid. As used herein, a "fluid" is a substance having a continuous phase that tends to flow and to conform to the outline of its container when the substance is tested at a temperature of 71° F. (22° C.) and a pressure of one atmosphere "atm" (0.1 megapascals "MPa"). A fluid can be a liquid or gas. A homogenous fluid has only one phase; whereas a heterogeneous fluid has more than one distinct phase. A heterogeneous fluid can be: a slurry, which includes an external liquid phase and undissolved solid particles as the internal phase; an emulsion, which includes an external liquid phase and at least one internal phase of immiscible liquid droplets; a foam, which includes an external liquid phase and a gas as the internal phase; or a mist, which includes an external gas phase and liquid droplets as the internal phase.

A well can include, without limitation, an oil, gas, or water production well, or an injection well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. The well can also include multiple wellbores, such as a main wellbore and lateral wellbores. As used herein, the term "wellbore" also includes a main wellbore as well as lateral wellbores that branch off from the main wellbore or from other lateral wellbores. A near-wellbore region is the subterranean material and rock of the subterranean formation surrounding the wellbore. As used herein, a "well" also includes the near-wellbore region. The near-wellbore region is generally considered to be the region within approximately 100 feet radially of the wellbore. As used herein, "into a well" means and includes into any portion of the well, including into the wellbore or into the near-wellbore region via the wellbore.

In an open-hole wellbore portion, a tubing string may be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; the space between the inside of a casing and the outside of a tubing string in a cased-hole wellbore; the space between a well tool and a casing in a cased-hole wellbore portion, and the space between a well tool and a wellbore wall in an open-hole wellbore portion.

It is not uncommon for a wellbore to extend several hundreds of feet or several thousands of feet into a subterranean formation. The subterranean formation can have different zones. A zone is an interval of rock differentiated from surrounding rocks on the basis of its fossil content or other features, such as faults or fractures. For example, one zone can have a higher permeability compared to another zone. Each zone of the formation can be isolated within the wellbore via the use of packers, plugs, or other similar devices.

It is often desirable to produce a reservoir fluid from one or more zones of a formation. However, there are problems associated with producing from or injecting into multiple formation zones. A zone with higher permeability can produce fluid at a higher rate when compared to another zone with reduced permeability. Higher flow rate from one zone may cause accelerated degradation of the wellbore components related to that zone due to the higher fluid velocities. Therefore, it may be desirable to reduce flow velocity from the high permeability zone by increasing flow restrictions to the fluid flow from that zone through the tubing string. It may also be desirable to isolate one zone from another to permanently seal off a lower zone from production, temporarily isolate a lower zone from an upper zone during treatment of the upper zone, or control fluid flow from the lower zone as it mixes with a fluid from the upper zone where the mixture is then flowed to the surface.

Selective production can be accomplished by installing a plug, such as a bridge plug, into the wellbore. The plug can define an upper and lower fluid passage through the wellbore. The plug can variably restrict fluid flow between the upper and lower passages during production or injection operations. A plug can be beneficial to production wells since limited support equipment may be needed to manage the installation, operation, and possible retrieval of the plug. The plug can be located and set within the wellbore. The plug can be permanent or retrievable, thereby enabling a lower zone to be permanently sealed from production and/or temporarily isolated from a treatment operation conducted on an upper zone. As used herein, "setting" and all grammatical variations thereof refers to longitudinally fixing a well tool in a wellbore. The setting can be performed by engaging an anchoring device with an inside of a component in the wellbore and/or sealingly engaging an annular seal element with the inside of the component, where the inside of the component can be an inner diameter of a casing in a cased wellbore, an inner diameter of the wall of the wellbore in an uncased wellbore, or an inner diameter of a tubing string in the wellbore.

Some plugs include a flow control device that provides a selectable restriction to fluid flow through the plug. This selectable restriction can be provided by selecting an orifice from a set of interchangeable orifices and screwing the selected orifice into the plug before installing the plug in the wellbore. Each of the interchangeable orifices has a fixed opening size that is different from the other orifices in the set. Therefore, selecting the orifice also selects the opening size for fluid flow through the plug.

Unfortunately, if the selected orifice does not produce a desired flow rate through the plug when the plug is set at a predetermined location in the wellbore, then the plug must be retrieved (or otherwise removed) to allow a plug with a different orifice to be set in the wellbore at the predetermined location. The undesired flow rate can be due to changing conditions in the wellbore, erroneous data used to make orifice size selection, selecting a wrong orifice size, etc. This iterative process of changing out plugs with different orifice sizes to achieve a desired flow rate requires multiple trips into the wellbore for each iteration. At least one trip to set the plug and another trip to retrieve the plug if the orifice needs to be changed. Due to the expense of tripping in and out of the wellbore, it is desirable to minimize the trips necessary to achieve a desired flow rate through the plug.

Additionally, setting the new plug with the new orifice back at the predetermined location from which the previous plug was retrieved (or otherwise removed) can also be problematic. It can take a significant amount of time to locate and set the new plug at substantially the same location as the previous plug. This can cause a sealing element of the plug to set prior to locating the plug at the predetermined location, if the sealing element is a swellable sealing element. Also, the setting tool used to set the plug at the predetermined location can have a time limitation that requires that the plug be set before a certain amount of time has elapsed. This problem can be more of an issue with deeper wellbores. Therefore, there is a need to provide a downhole controllable plug that allows for flow rate adjustments without having to retrieve the plug from the wellbore.

As used herein, the term "swell" and all grammatical variations thereof means an increase in volume of a material. Typically, this increase in volume is due to the swellable material imbibing a fluid within the material's structure. Note that swelling is not the same as expanding, although a material may expand as a result of swelling. For example, in some conventional packers, a seal element may be expanded radially outward by longitudinally compressing the seal element, or by inflating the seal element. In each of these cases, the seal element is expanded without any increase in volume of the material of which the seal element is made. Thus, in these conventional packers the seal element expands, but does not swell.

It has been discovered that a plug used to provide zonal isolation via the creation of one or more wellbore intervals can include a variable choke for adjusting the flow rate through the plug without retrieving or otherwise removing the plug from the wellbore. A rotary actuator can be used to adjust the variable choke by mechanically rotating a closure member of the variable choke while the plug remains set in the wellbore. The plug of the current disclosure does not require any directly connected control lines to adjust the variable choke, thereby maintaining the simplicity of a plug compared to more conventional inflow control devices, which usually require directly connected control lines for actuation.

As used herein, "variable choke" refers to a fluid flow control device that can be adjusted through open, partially open, and closed configurations, where the open configuration allows a maximum fluid flow rate through the device, the partially open configuration allows a fluid flow rate that is reduced from the maximum fluid flow rate through the device, and where the closed configuration prevents fluid flow through the device. It should be understood that there can be a minor amount of fluid flow through a plug in a closed configuration, but such amount should be only trivial or negligible.

According to a certain embodiment, a method for controlling fluid flow through a wellbore is provided, where the method can include introducing a plug, with a variable choke, into the wellbore, setting the plug in the wellbore, and mechanically adjusting the variable choke, thereby controlling a flow rate of a fluid through the plug.

According to another certain embodiment, a plug is provided that can control fluid flow through a flow passage in a wellbore, where the plug can include a body, an annular seal element that prevents fluid flow through an annulus between the body and an inside of a wellbore component when the annular seal element is set downhole, and a variable choke that can include a closure member, which is mechanically rotated downhole to adjust a fluid flow rate through the variable choke.

According to yet another certain embodiment, a method of mixing production fluids in a wellbore is provided, the method can include running a plug to a predetermined location in the wellbore, where the plug can include a variable choke. Setting the plug at the predetermined location, where the predetermined location is between first and second production zones. Producing a first fluid from the first production zone which is upstream from the plug, flowing the first fluid through the plug at a first flow rate, producing a second fluid from the second production zone which is downstream from the plug, mixing the first fluid with the second fluid in a portion of the flow passage that is downstream from the plug, mechanically rotating a closure member of the variable choke, and operating the variable choke to any one of closed, open and partially open configurations, thereby adjusting the flow of the first fluid through the plug. As used herein, the relative term "downstream" or "upper" means at a location closer to a wellhead, and "upstream" or "lower" means at a location further away from the wellhead.

Any discussion of the embodiments regarding the plug or any component of the plug is intended to apply to all of the apparatus and method embodiments.

Turning to the Figures, FIG. 1 depicts a well system 10. The well system 10 can include at least one wellbore 11. The wellbore 11 can include a casing 15. The wellbore 11 can penetrate a subterranean formation 20. The subterranean formation 20 can be a portion of a reservoir or adjacent to a reservoir. The subterranean formation 20 can have one or more zones, as seen in FIG. 1 with a first zone 12, a second zone 13, and a third zone 14.

The well system 10 can include multiple wellbore intervals, such as a first wellbore interval 16 and a second wellbore interval 18. The well system 10 can also include more than two wellbore intervals, for example, the well system 10 can further include a third wellbore interval, a fourth wellbore interval, and so on. At least one wellbore interval can correspond to a zone of the subterranean formation 20. By way of example, the first wellbore interval 16 can correspond to the first zone 12 and/or the second wellbore interval 18 can correspond to the second zone 13.

The wellbore 11 can include a longitudinally extending flow passage 24 that can carry production fluid from the zones 12, 13, 14 during production operations and can carry injection and/or treatment fluid from the surface to any of the zones 12, 13, 14. The flow passage 24 can be separated into upper and lower flow passages 24B, 24A by installing a plug 30 between zones 12 and 13, for example. The plug can isolate the upper and lower flow passages 24B, 24A from each other, so that pressure and/or fluid flow in one zone 12, 13, 14 does not affect the other zones 12, 13, 14.

It should be noted that the well system 10 illustrated in the drawings and described herein is merely one example of a wide variety of well systems in which the principles of this disclosure can be utilized. It should be clearly understood that the principles of this disclosure are not limited to any of the details of the well system 10, or components thereof, depicted in the drawings or described herein. Furthermore, the well system 10 can include other components not depicted in the drawing. For example, the well system 10 can further include a perforating gun assembly. By way of another example, FIG. 1 shows the wellbore 11 with a casing 15 and with cement filing an annulus between the wellbore and an outer diameter of the casing 15. However, the wellbore 11 can be an open-hole wellbore 11 without casing 15 or the cement.

Additionally, perforations may be included in the wellbore 11 at each of the zones 12, 13, 14 to assist in fluid flow between the zones and the flow passage 24; however, perforations are not required. As seen in FIG. 1, perforations 21 are formed at the first zone 12, and perforations 22 are formed at the second zone 13, but no perforations are formed at the third zone 14. Fractures (not shown) may also be formed at each of the zones 12, 13, 14 to further stimulate the zone.

In injection operations, fluid flow 69 into the wellbore can cause fluid flow 63 into the zone 12 through perforations 21, and fluid flow 65 into the zone 13 through perforations 22. Without plug 30 set in the wellbore 11, then the fluid flows 63, 65 into zones 12, 13, respectively, will largely depend upon the relative permeability of the zones 12, 13. The zone with a higher permeability can receive a larger portion of the fluid flow 69, with the lower permeability zone receiving a smaller portion of the fluid flow 69. Installing the plug 30 can provide variable fluid flow control between upper and lower flow passages 24B, 24A to control the portion of the fluid flow 69 that enters zone 13 (i.e., fluid flow 65), and the portion of the fluid flow 69 that enters zone 12 (i.e., fluid flow 63). This can allow the injection operation to treat both zones more equally without significant fluid loss into the higher permeability zone.

In production operations, fluid flow 68 can be produced to the surface via a flow passage in the wellbore 11. Fluid flow 68 can be a mixture or combination of the fluid flow 62 from zone 12 and the fluid flow 64 from zone 13. Without a plug 30, the amount of contributions of fluid flows 62, 64 to the fluid flow 68 is generally determined by fluid characteristics in each zone 12, 13 (e.g., fluid pressure, fluid type, fluid viscosity, etc.). However, installing the plug 30 can provide variable fluid flow control between upper and lower flow passages 24B, 24A to control the portion of the fluid flow 62 from zone 12 (indicated as fluid flow 60 that flows through the plug 30) that is mixed with the fluid flow 64 in the upper flow passage 24B to produce the fluid flow 68, which can flow to the surface.

This variable fluid flow control can be used advantageously for economically controlling mixtures of fluids from various formation zones to produce various fluid compositions. For example, a high quality fluid can be mixed with a lower quality fluid to produce a desired fluid composition that can increase the profitability of the well system 10. Additionally, a gas producing zone can be used to gas lift a fluid produced from another zone. By way of example, zone 12 can produce the fluid flow 62 that contains a pressurized gas, while zone 13 can produce the fluid flow 64 that contains a pressurized liquid hydrocarbon, where zone 13 may not produce sufficient fluid pressure to force a desired amount of the liquid hydrocarbons to the surface. Without the plug 30 installed in the wellbore 11, the gas production from zone 12 can overcome the liquid hydrocarbons being produced from zone 13, thereby reducing, if not eliminating, production of the liquid hydrocarbons. With the plug 30 installed in the wellbore 11, the amount of gas produced to the surface can be controlled, thereby enabling more of the liquid hydrocarbons to be produced. Controlling the amount of gas (e.g., fluid flow 60) that is mixed with the liquid hydrocarbons (e.g., fluid flow 64) in the upper flow passage 24B to produce the fluid flow 68 can be used to "gas lift" the liquid hydrocarbons to the surface. This can result in a desired amount of liquid hydrocarbons being produced at the surface without requiring the additional expense of injecting gas into the wellbore to provide the necessary "gas lift" for the liquid hydrocarbons.

The plug 30 can be installed in the wellbore at a predetermined location by conventional running tools. The running tool (not shown) can carry the plug 30 to the predetermined location. The running tool can also include a setting tool that sets the plug 30 at the predetermined location by engaging an anchoring device 37 with an inside surface of a wellbore component 23, such as the wall of the wellbore 11, or the inner surface of a casing 15 or tubing string. The setting tool can also set the plug 30 by expanding a seal element 38 into sealing contact with the inside of the wellbore component 23. It should also be understood that the plug 30 can be set in the wellbore 11 without using an anchoring device 37. In this configuration, the seal element 38 can be used to anchor the plug at the predetermined location in the wellbore as well as sealingly engage the wellbore component 23.

The anchoring device 37 can be any anchoring device that securely grips the wellbore component 23, thereby preventing further longitudinal movement of the plug 30 in the wellbore 11 while the anchoring device 37 is set. For example, the anchoring device 37 can be extendable slips, extendable dogs, an extendable gripping device, a lock mandrel or other lock mechanisms, expandable seal elements, etc. The seal element 38 can be any seal element (or group of seal elements) that expands (or extends) into sealing engagement with the wellbore component 23, thereby preventing fluid flow through the annulus 17 between the plug 30 and the wellbore component 23. For example, the seal element 38 can be an inflatable bladder that is inflated into sealing contact with the wellbore component 23. Alternatively, or in addition to, the seal element can be one or more swellable seal elements that surround the plug 30. When the swellable seal elements are contacted by an activating agent 39, the elements swell into sealing contact with the wellbore component 23. The activating agent 39 can be 1) flowed from the surface to the plug through the upper flow passage 24B, 2) contained in the setting tool and released when it is desired to swell the swellable seal elements, 3) already present in the wellbore, and/or 4) otherwise delivered to the plug to contact the swellable seal elements.

The plug 30 can include a body 31, a variable choke 32 with a closure member 34, upper and lower flow paths 26, 28, the anchoring device 37, and the seal element 38. The body 31 can include a stationary profile 36 that is rotationally fixed to the wellbore component 23 by the anchoring device 37 and/or the seal element 38. As used herein, the phrase "rotationally fixed" means that one item is substantially prevented from rotating relative to another item. As used herein, the phrase "substantially prevented" means that a slight relative rotation from approximately 0 to 10 degrees between the two items can occur while still being rotationally fixed. The closure member 34 can include a drive profile 35 that can rotate the closure member 34 (indicated by arrows 58) relative to the body 31 and selectively adjust the variable choke between closed, open, and partially open configurations. It should be understood that the variable choke can be any flow control device that can provide a variable restriction to flow through the device, such as a needle valve, a plug valve, a gate valve, a ball valve, a sleeve valve, and a flapper valve. It should also be understood that the variable flow restriction can include a valve that has only open and closed positions. As used herein, the term "selectively" (e.g., selectively moved between open and closed positions) and all grammatical variations thereof means that the different conditions being selected are not necessarily selected at the same time. Usually only one of these conditions is selected, but any of the different conditions can be selected.

The flow paths 26, 28 and the variable choke 32 can provide a continuous flow path through the plug to establish fluid communication between the upper flow passage 24B and the lower flow passage 24A. The lower flow path 26 can provide fluid communication between the lower flow passage 24A and the variable choke 32. The upper flow path 28 can provide fluid communication between the variable choke 32 and the upper flow passage 24B. The variable choke 32 can provide a variable restriction to flow through the plug's 30 continuous flow path. Therefore, with the variable choke 32 in the closed configuration, fluid flow 60, 61 through the plug 30 is prevented and the upper and lower flow passages 24B, 24A can be isolated from each other. The fluid flow 60, 61 through the plug 30 can be incrementally increased by incrementally opening the variable choke 32. With the variable choke 32 in the open configuration, the fluid flow 60, 61 through the plug 30 can be maximized. The fluid flow 60 is indicated as being fluid flow from the lower flow passage 24A, through the plug 30 and into the upper flow passage 24B for production operations. The fluid flow 61 is indicated as being fluid flow from the upper flow passage 24B, through the plug 30 and into the lower flow passage 24A for injection operations.

A rotary actuator 40 can travel through the longitudinal flow passage 24 on a conveyance 19 to engage the plug 30 and mechanically actuate the variable choke 32. As used herein, "conveyance" refers to a means of transporting a well tool through a tubing string. For example, the conveyance can be a coiled tubing, a wireline, a tractor system, a segmented tubing string, etc. As used herein, "mechanically" actuated, rotated, or adjusted refers to a device being actuated by the application of a mechanical force that acts on a component of the device without electrical energy, optical energy, magnetic coupling, or an increased fluid pressure being applied to the device. When the rotary actuator 40 engages the plug 30, a drive profile 43 engages the mating drive profile 35 on the closure member 34, thereby rotationally fixing the drive profile 43 to the drive profile 35, and a stationary profile 45 engages a stationary profile 36, thereby rotationally fixing the stationary profile 45 to the stationary profile 36. The rotary actuator 40 can rotate the drive member 42 and drive profile 43 relative to the stationary member 44 and stationary profile 45. Therefore, the rotary actuator 40 can rotate the closure member 34 (indicated by arrows 58) relative to the body 31.

The rotation 58 can cause the closure member 34 to vary the flow restriction through the variable choke 32, thereby actuating the variable choke 32 to at least one of a closed, an open and a partially open configuration. The rotation 58 can cause the closure member 34 to move rotationally and/or longitudinally to actuate the variable choke 32. For example, if the closure member 34 is threaded into the variable choke 32, then the rotation 58 can cause the closure member 34 to move both longitudinally and rotationally. However, if the closure member 34 mates to longitudinal splines in the variable choke 32, then the closure member 34 can be restricted to only longitudinal movement. Additionally, if the variable choke is a ball valve, then the closure member 34 can be restricted to only rotational movement.

Figure 3:
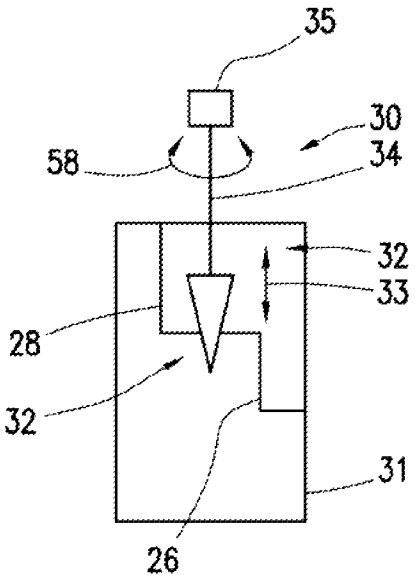
Figure 2:
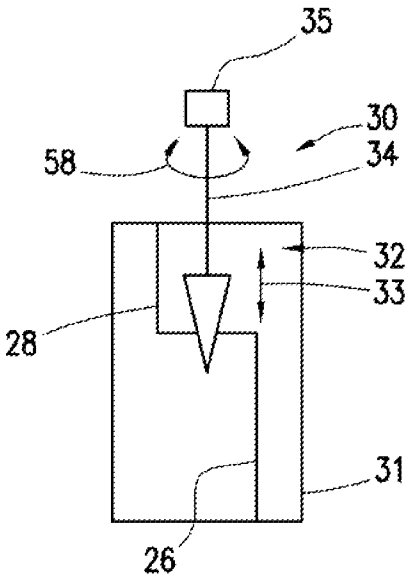

Referring now to FIGS. 2-6, these figures show a variety of configurations for the variable choke 32 that can be used with the plug 30. FIG. 2 depicts a plug 30 with a needle valve as the variable choke 32. As the conical shaped closure member 34 is threaded up and down in the body 31, the closure member 34 moves both rotationally and longitudinally as shown by arrows 58 and 33, respectively. The longitudinal movement 33 of the closure member 34 can vary the flow restriction through the variable choke 32. FIG. 3 depicts a plug 30 that is very similar to the plug 30 in FIG. 2. However, FIG. 3 illustrates that fluid can enter or exit the lower flow path 26 through a side of the body 31 as opposed to the bottom of the body 31, as in FIG. 2. It should be understood that both the upper and lower flow paths 26, 28 may provide fluid communication through an end and/or side of the body 31, as long as one flow path 26, 28 is in fluid communication with the lower flow passage 24A, and the other one of the flow paths 26, 28 is in fluid communication with the upper flow passage 24B.

Figure 4:
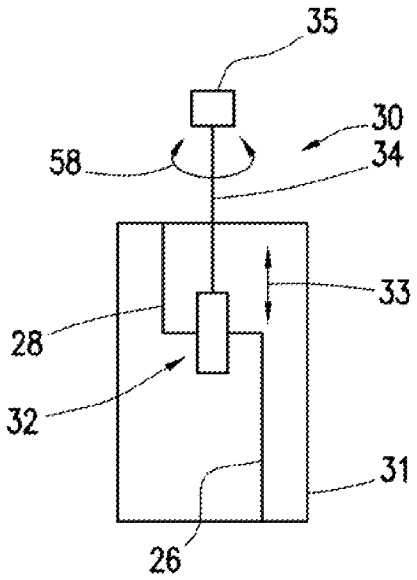
FIGS. 2-5 depict schematic representations of the plug with various rotary actuated variable chokes.
Figure 5:
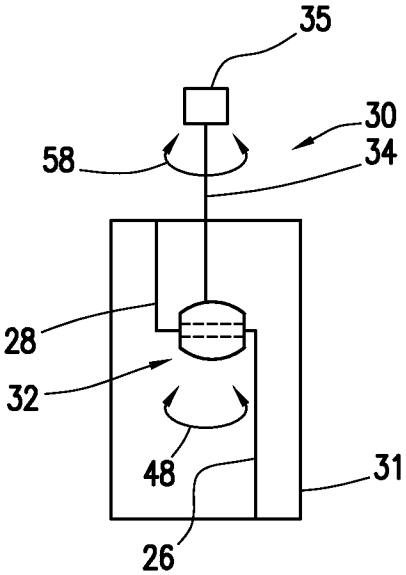

FIG. 4 depicts a plug 30 with a gate valve as the variable choke 32. As the closure member 34 is rotated, the rotation 58 causes the closure member 34 to also move longitudinally as indicated by the arrow 33. This longitudinal movement 33 of the closure member 34 can vary the flow restriction through the variable choke 32. FIG. 5 depicts a plug 30 with a ball valve as the variable choke 32. As the closure member 34 is rotated, a ball in the variable choke 32 is also rotated, as indicated by arrows 48. The rotation 48 of the ball can vary the flow restriction through the variable choke 32.

Figure 6:
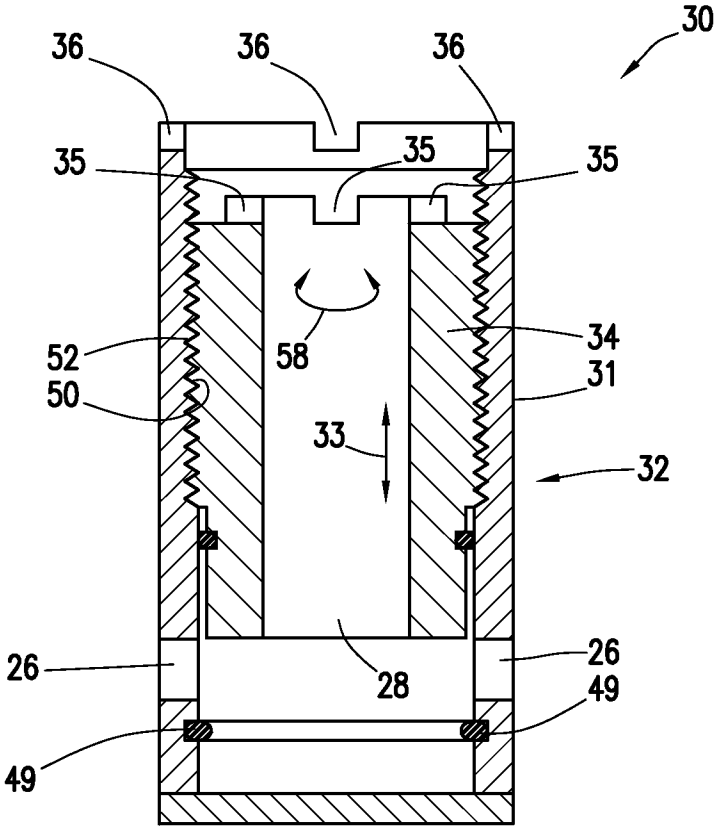
FIG. 6 depicts a partial cross-sectional view of the plug with yet another rotary actuated variable choke.

FIG. 6 depicts a plug 30 with a sleeve valve as the variable choke 32. When the plug 30 is engaged with the rotary actuator 40 (or any other actuator 40 capable of imparting mechanical rotation to the closure member 34), drive profiles 35 are engaged with mating drive profiles 43 of the rotary actuator 40 (see FIG. 1), and the stationary profiles 36 are engaged with the stationary profiles 45 of the rotary actuator 40. When the drive profiles 35, 43 are rotated relative to the stationary profiles 36, 45, the closure member 34 is rotated relative to the body 31. FIG. 6 shows a variation of the drive profile 35 when compared to the drive profile 35 in FIG. 7. However, these profiles are not mutually exclusive. The recess-type profile 35 in FIG. 7 can also be used with the closure member 34 in FIG. 6, and the ring-type profile 35 in FIG. 6 can also be used with the closure member 34 in FIG. 7. Many other modifications to the drive and stationary profiles are also possible.

Referring again to FIG. 6, threads 52 on an outer wall of the closure member 34 can be threaded into threads 50 on an inner wall of the body 31. Rotation 58 of the closure member causes the threaded interface between threads 50 and 52 to move longitudinally (movement 33) up or down within the body 31. The flow path 28 is indicated as being an internal bore of the closure member 34. The flow path 26 includes multiple openings in the side wall of the body 31. As the closure member 34 is moved down, the openings of flow path 26 are incrementally blocked, thereby increasing flow restriction through the variable choke 32. If the closure member 34 moves down enough to engage an annular seal 49 (such as an O-ring), then the variable choke 32 would be in a fully closed configuration, thereby preventing fluid flow through the flow passage 26 into or out of the variable choke 32. Any of the plugs 30 shown in FIGS. 2-6 can be used as the plug 30 in the well system 10 shown in FIG. 1.

Figure 7:
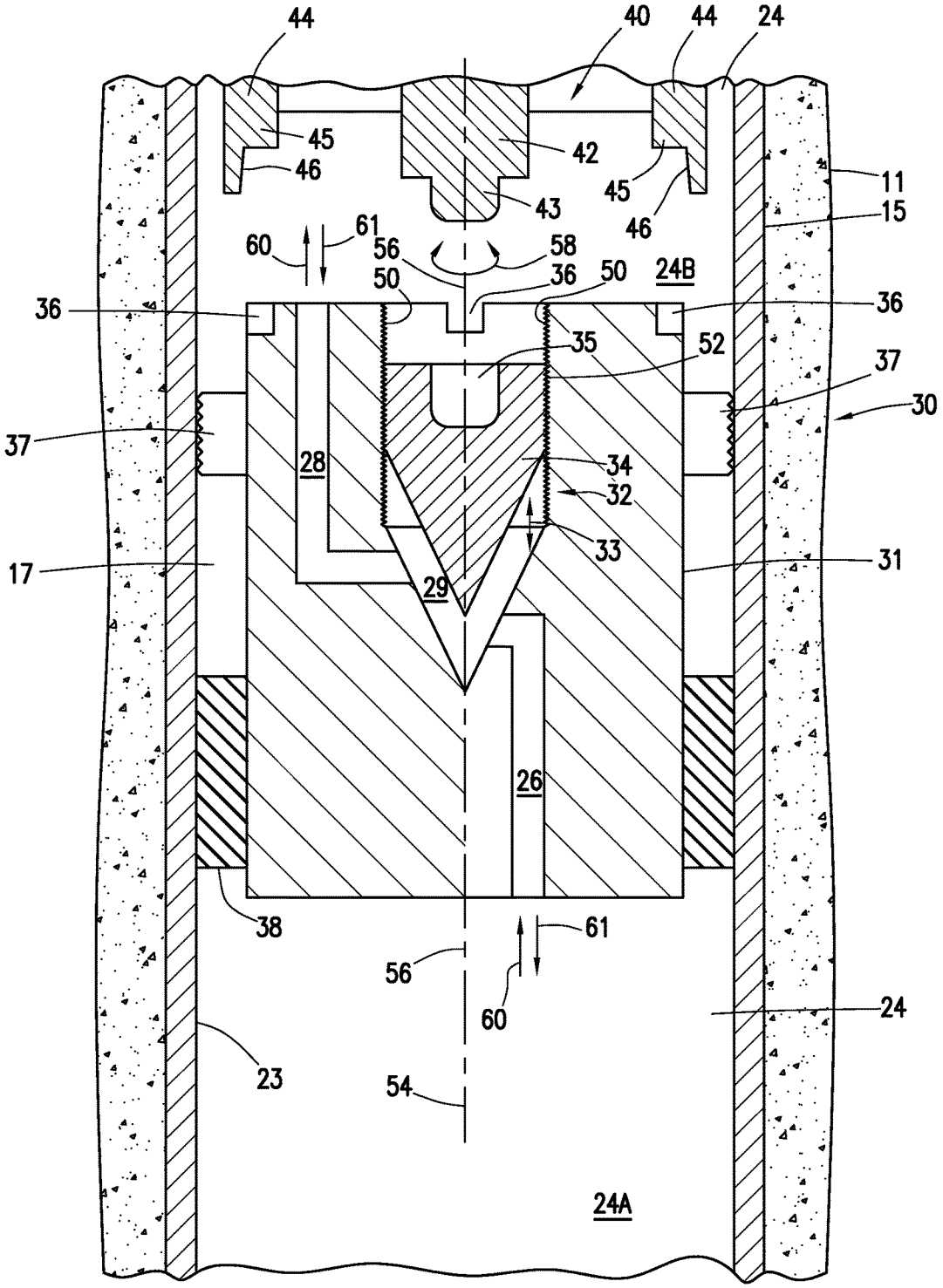
FIG. 7 depicts a detailed cross-sectional view of a plug similar to the plug shown in FIG. 2.

FIG. 7 depicts a more detailed partial cross-sectional view of a plug 30. The plug 30 is very similar to the plug 30 shown in FIG. 2. The plug 30 has already been set at the predetermined location by engaging the anchoring device 37 with the wellbore component 23 and expanding the seal element 38 into sealing contact with the wellbore component 23. Fluid flow through the annulus 17 is prevented by the expanded seal element 38 and fluid communication between the lower flow passage 24A and the upper passage 24B is established through the flow paths 26, 28 and the flow chamber 29. The variable choke 32 was preset to at least a partially open configuration prior to being installed in the wellbore 11. The variable choke 32 may have been set to the particular partially open configuration to provide a flow rate through the plug 30 that is estimated to provide a desired flow rate. After the plug is set, an actual flow rate of the fluid flowing through the plug 30 (fluid flow 60 for production, and fluid flow 61 for injection) can be determined.

If the actual flow rate is substantially equal to the desired flow rate (where "substantially equal" means that the actual flow rate is within an acceptable range when compared to the desired flow rate), then no further adjustment of the variable choke 32 is necessary. The actual flow rate may change over time as the conditions downhole change, but as long as the actual flow rate remains substantially equal to the desired flow rate, then adjustments of the variable choke 32 may not be necessary. However, if the actual flow rate does not substantially equal the desired flow rate, then adjustments to the variable choke 32 can be performed to change the flow rate through the variable choke 32 to be substantially equal the desired flow rate.

These adjustments can be made downhole while the plug 30 remains set in the wellbore 11. A rotary actuator 40 can be run into the well on the conveyance 19 (FIG. 1) into engagement with the plug 30. FIG. 7 depicts the rotary actuator 40 separated from the plug 30 for clarity, but, when engaged, the actuator 40 and plug 30 can be in contact with each other. The drive profile 43 on the drive member 42 engages the drive profile 35 on the closure member 34. The stationary profiles 45 on the stationary member 44 engage the profiles 36 on the body 31 of the plug 30. Inclined surfaces 46 can be used to help axially align the rotary actuator 40 with the plug 30. Once the rotary actuator 40 is engaged with the plug 30, the drive member can rotate the closure member 34 about the center axis 56 via the engaged drive profiles 35, 43. The center axis 56 of the plug is shown aligned with the center axis 54 of the flow passage 24. However, it is not necessary for the axis 56 to be aligned with the axis 54. For example, an eccentric seal element can offset the axis 56 from the axis 54. The rotation 58 of the closure member 34 relative to the body 31 can cause the threaded connection between threads 50, 52 to move the closure member 34 longitudinally, as indicated by arrows 33. The longitudinal movement 33 of the closure member 34 can actuate the variable choke to one of closed, open and partially open configurations.

Therefore, the present system is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. As used herein, the words "comprise," "have," "include," and all grammatical variations thereof are each intended to have an open, non-limiting meaning that does not exclude additional elements or steps. While compositions and methods are described in terms of "comprising," "containing," or "including" various components or steps, the compositions and methods also can "consist essentially of" or "consist of" the various components and steps.

Whenever a numerical range with a lower limit and an upper limit is disclosed, any number and any included range falling within the range is specifically disclosed. In particular, every range of values (of the form, "from about a to about b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method for controlling fluid flow through a wellbore, the method comprising:

introducing a plug into the wellbore, wherein the plug comprises a variable choke and a closure member; and setting the plug in the wellbore, wherein a flow rate of a fluid flowing through the plug is controlled by mechanically adjusting the variable choke, and wherein the choke is adjusted within the wellbore via rotation of the closure member;

wherein a first drive profile on the closure member engages a second drive profile on a drive member of a rotary actuator, thereby rotationally fixing the closure member to the drive member, wherein a first stationary profile on a body of the plug engages a second stationary profile on a stationary member of the rotary actuator, thereby rotationally fixing the body to the stationary member, and wherein rotation of the drive member by the rotary actuator rotates the closure member relative to the body, thereby adjusting the variable choke.

2. The method according to claim 1, wherein the closure member selectively moves between closed, open and partially open configurations in response to the rotation.

3. The method according to claim 1, wherein the closure member moves longitudinally in response to the rotation.

4. The method according to claim 1, further comprising:
causing or allowing a fluid to flow through the plug at a first flow rate;
determining the first flow rate;
mechanically adjusting the choke within the wellbore in response to the first flow rate, wherein the adjustment provides a second flow rate through the plug; and
causing or allowing the fluid to flow through the plug at the second flow rate.

5. The method according to claim 4, wherein the step of mechanically adjusting is performed in response to the first flow rate being different than a desired flow rate.

6. The method according to claim 1, wherein the step of setting further comprises anchoring the plug at a predetermined location in the wellbore with an anchoring device, and wherein the anchoring device is selected from the group consisting of a slip, a gripping device, and a lock mechanism.

7. The method according to claim 1, wherein the step of setting further comprises expanding a sealing element to sealingly engage an inside of a wellbore component, thereby preventing flow through an annulus between an outside of the plug and the inside of the wellbore component.

8. The method according to claim 1, wherein the step of setting further comprises swelling a swellable sealing element to sealingly engage an inside of a wellbore component, thereby preventing flow through an annulus between outside of-the plug and the inside of the wellbore component.

9. The method according to claim 1, further comprising isolating an upper portion of a flow passage in the wellbore from a lower portion of the flow passage when the plug is set and the variable choke is in a closed configuration.

10. The method according to claim 1, wherein the variable choke is selected from the group consisting of a needle valve, a plug valve, a gate valve, a ball valve, a sleeve valve and a flapper valve.

11. A plug that controls fluid flow through a flow passage in a wellbore, the plug comprising:
a body;
an annular seal element that prevents fluid flow through an annulus between an outside of the body and an inside of a wellbore component when the annular seal element is set in the wellbore; and
a variable choke comprising a closure member, wherein the closure member is mechanically rotated in the wellbore to adjust a flow rate of a fluid flowing through the variable choke;
wherein a first drive profile on the closure member engages a second drive profile on a drive member of a rotary actuator, thereby rotationally fixing the closure member to the drive member, wherein a first stationary profile on the body of the plug engages a second stationary profile on a stationary member of the rotary actuator, thereby rotationally fixing the body to the stationary member, and wherein rotation of the drive member by the rotary actuator rotates the closure member relative to the body, thereby adjusting the variable choke.

12. The plug according to claim 11, wherein the annular seal element expands into contact with the wellbore component and prevents flow through the annulus when the annular seal element is expanded.

13. The plug according to claim 11, wherein the annular seal element includes a swellable seal element, which swells when contacted by a swelling fluid, and wherein the annular seal element prevents flow through the annulus when the swellable seal element has swelled.

14. The plug according to claim 11, further comprising an anchoring device that anchors the plug at a predetermined location in the wellbore, and wherein the anchoring device is selected from the group consisting of a slip, a gripping device and a lock mechanism.

15. The plug according to claim 11, wherein the variable choke is selected from the group consisting of a needle valve, a plug valve, a gate valve, a ball valve, a sleeve valve and a flapper valve.

16. The plug according to claim 11, wherein the fluid flows through the plug at a first flow rate, wherein the variable choke is adjusted downhole to produce a second flow rate through the plug, and wherein the second flow rate is different from the first flow rate.

17. The plug according to claim 11, wherein the closure member selectively moves between closed, open, and partially open configurations in response to the mechanical rotation.

18. A method of mixing production fluids in a wellbore of a subterranean formation, the method comprising:
running a plug to a predetermined location in the wellbore, wherein the plug includes a variable choke;
setting the plug at the predetermined location, wherein the predetermined location is between first and second zones of the subterranean formation;
producing a first fluid from the first zone;
flowing the first fluid through the plug at a first flow rate;
producing a second fluid from the second zone;
mixing the first fluid with the second fluid to form a mixed fluid in a portion of a flow passage that is downstream from the plug;
mechanically rotating a closure member of the variable choke;
operating the variable choke to any one of closed, open, and partially open configurations in response to the rotation, wherein the configuration adjusts the flow rate of the first fluid through the plug;
flowing the mixed fluid to the surface; and
determining the amounts of first and second fluids contained in the mixed fluid, wherein the step of operating is performed in response to an amount of the first and second fluids.

19. The method according to claim 18, wherein the mixed fluid contains desired amounts of the first and second fluids after the adjustment of the flow rate of the first fluid.

20. The method according to claim 18, wherein the first fluid is a gas and the second fluid is a liquid.

* * * * *